US008006335B1

(12) United States Patent
Andermann

(10) Patent No.: US 8,006,335 B1
(45) Date of Patent: Aug. 30, 2011

(54) POST RETINAL OPERATION PILLOW

(76) Inventor: Kenneth Andermann, Roxie, MS (US)

( * ) Notice: Subject to any disclaimer, the term of this patent is extended or adjusted under 35 U.S.C. 154(b) by 0 days.

(21) Appl. No.: 12/626,593

(22) Filed: Nov. 25, 2009

(51) Int. Cl.
*A47G 9/00* (2006.01)
*A61G 7/07* (2006.01)

(52) U.S. Cl. ..... 5/638; 5/632

(58) Field of Classification Search ..... 5/638, 637, 5/636, 632, 630, 724, 725, 652.1
See application file for complete search history.

(56) References Cited

U.S. PATENT DOCUMENTS

| | | | | |
|---|---|---|---|---|
| 2,107,962 | A * | 2/1938 | Sheasby | 5/638 |
| 3,315,282 | A * | 4/1967 | Lowery et al. | 5/638 |
| 3,366,106 | A | 1/1968 | Yao et al. | |
| 4,688,285 | A * | 8/1987 | Roberts | 5/630 |
| D298,992 | S | 12/1988 | Voss | |
| D405,308 | S | 2/1999 | Orozco | |
| 5,960,494 | A | 10/1999 | Gilliland et al. | |
| 6,128,797 | A * | 10/2000 | Shaffer | 5/638 |
| 6,230,350 | B1 * | 5/2001 | Goldstein | 5/638 |
| 6,412,127 | B1 * | 7/2002 | Cuddy | 5/632 |
| 6,427,272 | B1 | 8/2002 | Yacoub | |
| 6,745,418 | B1 * | 6/2004 | Turner, Jr. | 5/638 |
| 6,842,924 | B1 | 1/2005 | Walters | |
| 6,922,860 | B2 * | 8/2005 | Cuddy | 5/632 |
| 2004/0155158 | A1 * | 8/2004 | Cuddy | 248/118 |
| 2006/0265808 | A1 | 11/2006 | Phillips | |

* cited by examiner

*Primary Examiner* — Robert G Santos
(74) *Attorney, Agent, or Firm* — Kyle Fletcher

(57) ABSTRACT

The post-retinal operation pillow is comprised of a cylindrical top and a slightly angled base of which a plurality of vents extend therefrom. The slightly angled base has an opening that aligns with the open inner circle of the cylindrical top. The post retinal operation pillow may be of single construction or a plurality of pieces. The post retinal operation pillow provides enhanced comfort to those individuals that are required to maintain a horizontal position of their head after an operation involving the retina or eye.

17 Claims, 3 Drawing Sheets

POST RETINAL OPERATION PILLOW

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This invention relates to the field of pillows, more specifically, a pillow that is designed for use with patients after having surgical procedures involving the retina or eyes.

After retina surgery, most patients are told to keep their heads in a horizontal position for 12 to 23 hours per day, which can be very difficult. That being said, it can be difficult to breathe, sleep, or simply lie awake in said position.

The present invention seeks to overcome this challenge by providing a pillow that enables a patient to comfortably position his or her head in the required horizontal position for prolonged periods of time.

B. Discussion of the Prior Art

As a preliminary note, it should be stated that there is an ample amount of prior art that deals with pillows. As will be discussed immediately below, no prior art discloses a pillow having a generally cylindrical top of which a plurality of vents that are equally spaced from which a pillow base attaches there under and of which is slightly angled and further includes more vents.

The Phillips Patent Application (U.S. Pub. No. 2006/0265808) discloses a face cradle pillow having a semi-circular contour or bowl. However, the face cradle pillow does not have a base that is slightly angled and of which includes a plurality of vents to enable air to pass easily in/out for respiratory purposes.

The Voss Patent (U.S. Pat. No. Des. 298,992) illustrates a design for a face pillow, which does not depict a slightly angled base.

The Orozco Patent (U.S. Pat. No. Des. 405,308) illustrates a design for a face pillow, which does not depict a slightly angled base.

The Walters Patent (U.S. Pat. No. 6,842,924) discloses a surgical pillow for supporting a patient in a face down position. However, the surgical pillow does not have a cylindrical top mounted upon a slightly angled base.

The Yacoub Patent (U.S. Pat. No. 6,427,272) discloses an anesthesia pillow. However, the pillow does not have a cylindrical top mounted upon a slightly angled base.

The Gilliland et al. Patent (U.S. Pat. No. 5,960,494) discloses a surgical pillow for use on a patient in the prone (face down) position. However, the surgical pillow is not composed of a cylindrical top mounted upon a slightly angled base from which a plurality of vents are integrated to assist in respiration.

The Kou C. Yao et al Patent (U.S. Pat. No. 3,366,106) discloses a face resting pillow with apertures. However, the pillow is not composed of a cylindrical top mounted upon a slightly angled base from which a plurality of vents are integrated to assist in respiration.

While the above-described devices fulfill their respective and particular objects and requirements, they do not describe a pillow having a generally cylindrical top of which a plurality of vents that are equally spaced from which a pillow base attaches there under and of which is slightly angled and further includes more vents. In this regard, the post retinal operation pillow departs from the conventional concepts and designs of the prior art.

SUMMARY OF THE INVENTION

The post-retinal operation pillow is comprised of a cylindrical top and a slightly angled base of which a plurality of vents extend therefrom. The slightly angled base has an opening that aligns with the open inner circle of the cylindrical top. The post retinal operation pillow may be of single construction or a plurality of pieces. The post retinal operation pillow provides enhanced comfort to those individuals that are required to maintain a horizontal position of their head after an operation involving the retina or eye.

It is an object of the invention to provide a pillow that enables a person to rest his or head facing downwards.

A further object of the invention is to provide a cylindrical top and a slightly angled base both of which have an inner circular opening adjacent a face of an end user.

A further object of the invention is to provide a pillow having a plurality of vents in the cylindrical top for assisting respiration.

A further object of the invention is to provide a pillow having a plurality of vents in the base for assisting respiration.

A further object of the invention is to include a pillow made of a soft material.

These together with additional objects, features and advantages of the post retinal operation pillow will be readily apparent to those of ordinary skill in the art upon reading the following detailed description of presently preferred, but nonetheless illustrative, embodiments of the post retinal operation pillow when taken in conjunction with the accompanying drawings.

In this respect, before explaining the current embodiments of the post retinal operation pillow in detail, it is to be understood that the post retinal operation pillow is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the post retinal operation pillow.

It is therefore important that the claims be regarded as including such equivalent construction insofar as they do not depart from the spirit and scope of the post retinal operation pillow. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
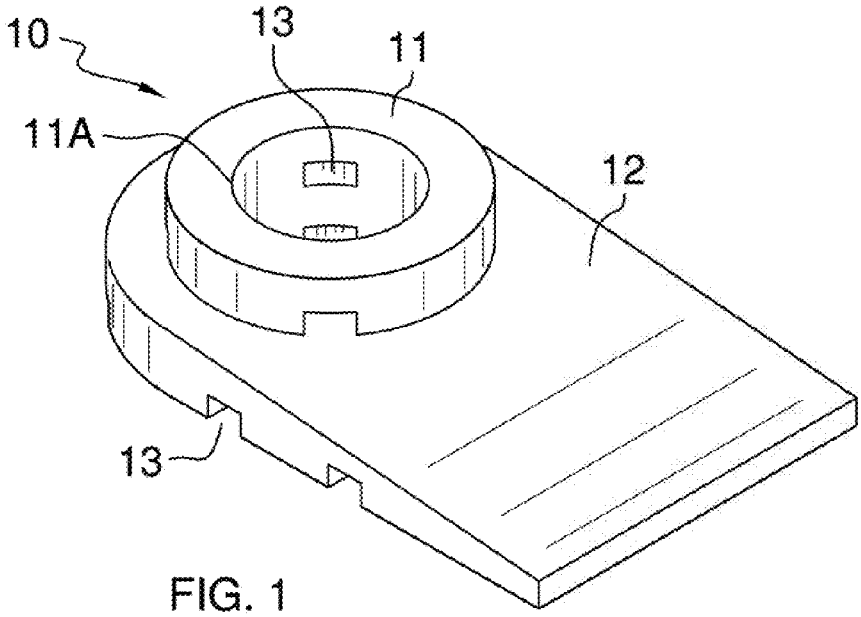
FIG. 1 illustrates a top, isometric view of the post retinal operation pillow by itself.
Figure 2:
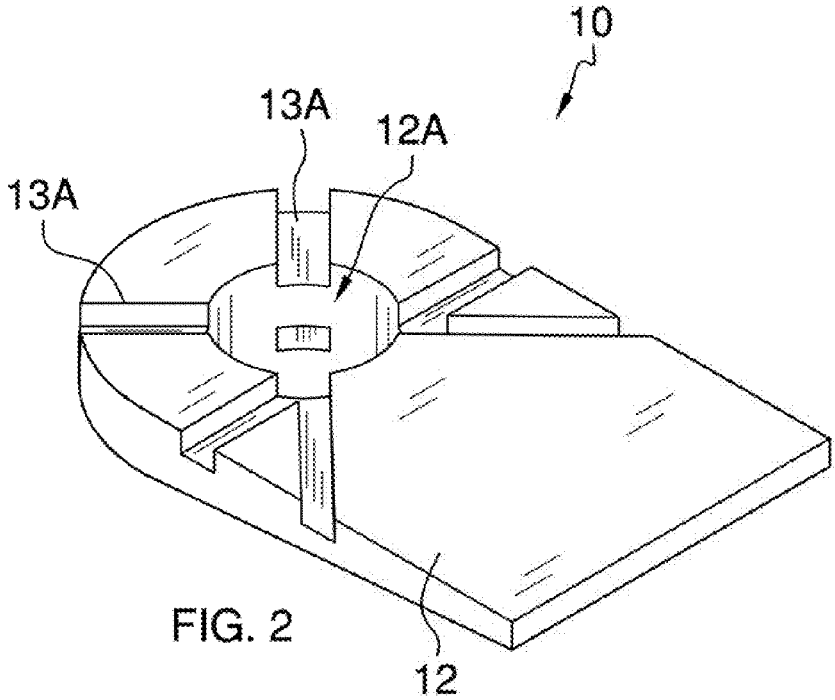
FIG. 2 illustrates a bottom, isometric view of the post retinal operation pillow detailing some of the vents located along a bottom surface of the angled base.
Figure 3:
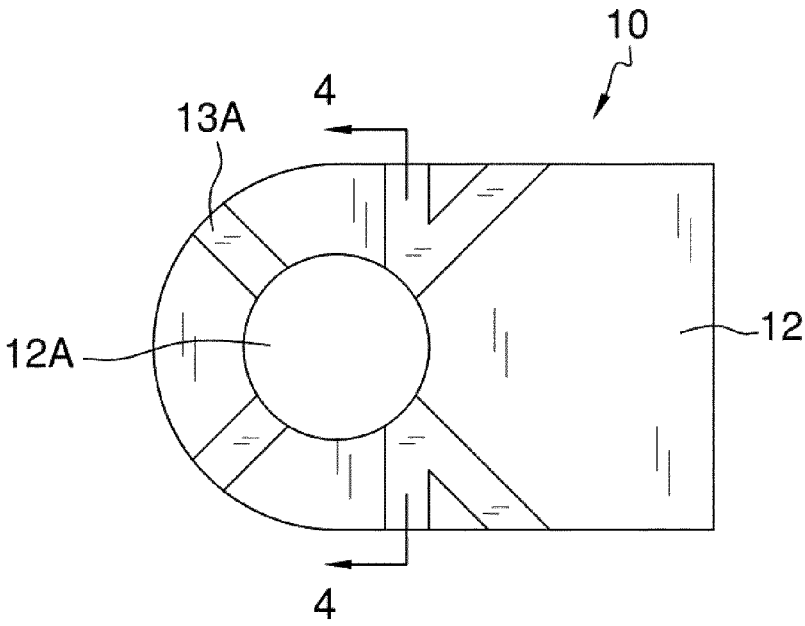
FIG. 3 illustrates a top view of the post retinal operation pillow.

Detailed reference will now be made to the preferred embodiment of the present invention, examples of which are illustrated in FIGS. 1-5. A post retinal operation pillow 10 (hereinafter invention) includes a cylindrical top 11 and a base 12.

The cylindrical top 11 has an inner circle 11A for an end user's face 30, and of which is positioned atop the base 12. The base 12 has an inner circle 12A that aligns with the inner circle 11A of the cylindrical top 11.

It shall be further noted that an outer diameter of the cylindrical top 11 is less than an outer diameter of the base 12. This distinction in outer diameters is to improve the overall stability of the invention 10. However, said distinction does not improve the overall comfort of the invention 10.

The base 12 and the cylindrical top 11 have a plurality of vents 13 that enable said end user to breathe while said end user's face is placed upon said inner circle 11A.

The vents 13 located on the cylindrical top 11 are equally spaced about the cylindrical top 11. The vents 13 located on the base 12 extend radially away from the inner circle 12A via channels 13A.

The base 11 may be slightly angled, and wherein said angle may range from 1 degree to 90 degrees.

The cylindrical top 11 and the base 12 may be comprised of a single piece construction or two distinct pieces. If the latter, then the two distinct pieces are adhered together via a fastening means comprising adhesive, stitching, snap-buttons, grommets, at least one zipper.

The cylindrical top 11 and the base 12 are made of a soft material comprising a visco-elastic foam, a sponge, or a lining filled with stuffing. Said stuffing may comprise cotton, down feathers, Styrofoam pellets, or PVC pellets.

Figure 4:
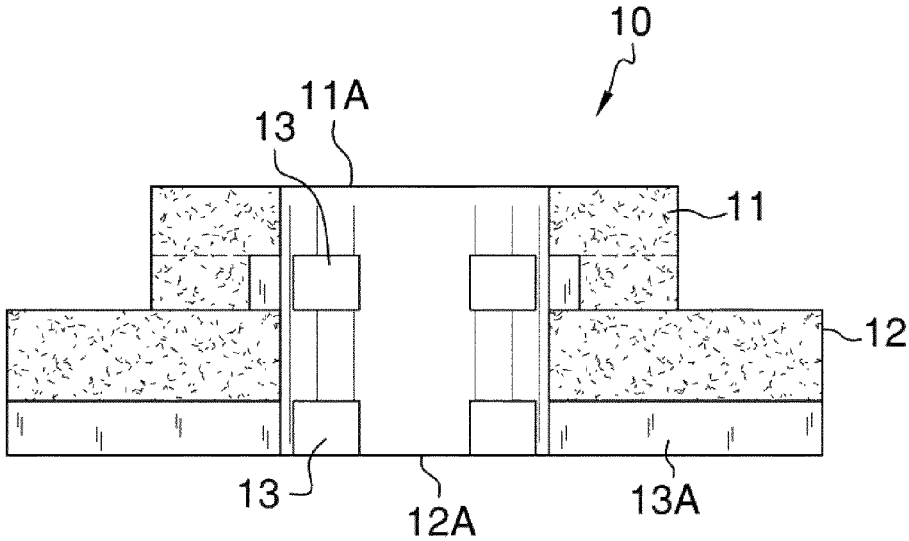
FIG. 4 illustrates a cross-sectional view of the post retinal operation pillow along line 4-4 in FIG. 3 and detailing the plurality of vents included within both the cylindrical top and angled base.
Figure 5:
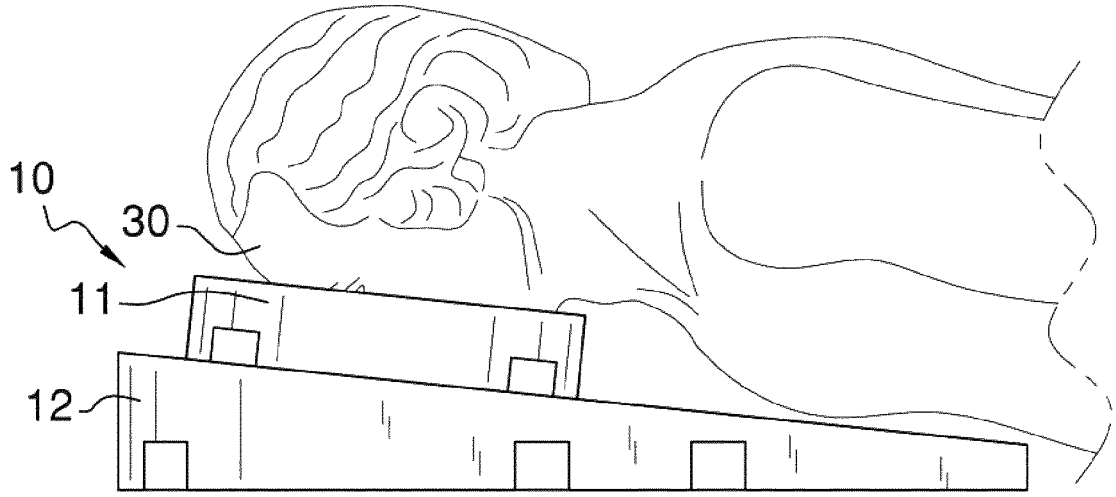
FIG. 5 illustrates a side view of the invention in use.

Referring to FIGS. 4 and 5, an end user 30 simply lays flat face first with his or face positioned over the inner circle 11A. The inclusion of the inner circles 11A and 12A provide ample room between the end user's 30 face and the ground. The room between the end user's 30 face and the ground is supplied with fresh air via the plurality of vents 13 and channels 13A. Also, the plurality of vents 13 and channels 13A enable exhaled air from the end user 30 to escape the invention 10. It is important to provide ventilation to the end user 30 as well as a soft material that cushions the weight exerted by the face of the end user 30.

It is also worth noting that the base 12 has an elongated frontal area that extends away from both the channels 13A as well as the inner circle 12A. This elongated frontal area serves two purposes (1) it increases the overall stability of the invention 10 by making it more difficult to flip the invention 10 over, and (2) it provides a cushioned region from which the end user's 30 upper torso is cushioned from the ground. It shall be noted that the elongated frontal area of the base 12 shall be no less than 8 inches in length.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A surgical pillow comprising:

wherein said pillow has a cylindrical top having an inner circle for an end user's face, and of which is positioned atop a base;

wherein the base has a plurality of vents that enable said end user to breathe while said end user's face is placed upon said inner circle;

wherein the cylindrical top has a plurality of vents that enable said end user to breathe while said end user's face is placed upon said inner circle;

wherein said base has an elongated frontal area that extends horizontally away from the cylindrical top in order to provide a cushioned surface from which an end user may rest an upper torso.

2. The surgical pillow as described in claim 1 wherein the base is angled with an angle that ranges from 1 degree to 90 degrees.

3. The surgical pillow as described in claim 1 wherein the base and the cylindrical top are comprised of two distinct pieces that are adhered together via a fastening means comprising adhesive, stitching, snap-buttons, grommets, at least one zipper.

4. The surgical pillow as described in claim 1 wherein the base and the cylindrical top are comprised of a single piece construction.

5. The surgical pillow as described in claim 1 wherein the pillow is made of a soft material comprising a visco-elastic foam, a sponge, or a lining filled with stuffing;

wherein said stuffing may comprise cotton, down feathers, pellets formed from expanded plastic, such as those sold under the Trademark of Styrofoam, or PVC pellets.

6. A surgical pillow comprising:

wherein said pillow has a cylindrical top having an inner circle for an end user's face, and of which is positioned atop a base having an inner circle generally aligned with the inner circle of the cylindrical top;

wherein the cylindrical top has a plurality of vents that enable said end user to breathe while said end user's face is placed upon said inner circle of the cylindrical top;

wherein said base has an elongated frontal area that extends horizontally away from the cylindrical top in order to provide a cushioned surface from which an end user may rest an upper torso.

7. The surgical pillow as described in claim 6 wherein the base has a plurality of vents that enable said end user to breathe while said end user's face is placed upon said inner circle, and wherein said vents extend radially away from said inner circle of the base via channels.

8. The surgical pillow as described in claim 6 wherein the base is angled; and wherein said angle ranges from 1 degree to 90 degrees.

9. The surgical pillow as described in claim 6 wherein the base and the cylindrical top are comprised of two distinct pieces that are adhered together via a fastening means comprising adhesive, stitching, snap-buttons, grommets, at least one zipper.

10. The surgical pillow as described in claim 6 wherein the base and the cylindrical top are comprised of a single piece construction.

11. The surgical pillow as described in claim 6 wherein the pillow is made of a soft material comprising a visco-elastic foam, a sponge, or a lining filled with stuffing; wherein said stuffing may comprise cotton, down feathers, pellets formed from expanded plastic, such as those sold under the Trademark of Styrofoam, or PVC pellets.

12. A surgical pillow comprising:

wherein said pillow has a cylindrical top having an inner circle for an end user's face, and of which is positioned atop a base having an inner circle generally aligned with the inner circle of the cylindrical top;

wherein the base has a plurality of vents that extend from within said inner circle of the base radially via channels, which enable said end user to breathe while said end user's face is placed upon said inner circle;

wherein the cylindrical top has an outer diameter that is less than the outer diameter of the base;

wherein said base has an elongated frontal area that extends horizontally away from the cylindrical top in order to provide a cushioned surface from which an end user may rest an upper torso.

13. The surgical pillow as described in claim 12 wherein the cylindrical top has a plurality of vents that enable said end user to breathe while said end user's face is placed upon the cylindrical top inner circle.

14. The surgical pillow as described in claim 12 wherein the base is angled; and wherein said angle ranges from 1 degree to 90 degrees.

15. The surgical pillow as described in claim 12 wherein the base and the cylindrical top are comprised of two distinct pieces that are adhered together via a fastening means comprising adhesive, stitching, snap-buttons, grommets, at least one zipper.

16. The surgical pillow as described in claim 12 wherein the base and the cylindrical top are comprised of a single piece construction.

17. The surgical pillow as described in claim 12 wherein the pillow is made of a soft material comprising a visco-elastic foam, a sponge, or a lining filled with stuffing;

wherein said stuffing may comprise cotton, down feathers, pellets formed from expanded plastic, such as those sold under the Trademark of Styrofoam, or PVC pellets.

* * * * *